United States Patent [19]

Aubert

[11] Patent Number: 4,705,582

[45] Date of Patent: Nov. 10, 1987

[54] DESENSITIZED EXPLOSIVE COMPOSITION

[76] Inventor: Stephen A. Aubert, 300 Greenwood Cove North, Niceville, Fla. 32578

[21] Appl. No.: 925,960

[22] Filed: Nov. 3, 1986

[51] Int. Cl.[4] ..... C06B 25/34

[52] U.S. Cl. ..... 149/92; 149/39; 149/93; 149/99; 149/105

[58] Field of Search ..... 149/105, 92, 99, 93, 149/39

[56] References Cited

U.S. PATENT DOCUMENTS

| | | | |
|---|---|---|---|
| 3,447,978 | 6/1969 | Bluhm | 149/2 |
| 3,472,713 | 10/1969 | Berthmann et al. | 149/92 |
| 3,706,609 | 12/1972 | Voigt, Jr. et al. | 149/18 |
| 4,000,021 | 12/1976 | Voigt, Jr. | 149/17 |
| 4,284,442 | 8/1981 | Voigt, Jr. | 149/19.4 |
| 4,445,948 | 5/1984 | Stanton et al. | 149/19.91 |
| 4,543,136 | 9/1985 | Edamura et al. | 149/105 |
| 4,543,137 | 9/1985 | Edamura et al. | 149/105 |

*Primary Examiner*—Stephen J. Lechert, Jr.

*Attorney, Agent, or Firm*—Charles E. Bricker; Donald J. Singer

[57] ABSTRACT

Explosive compositions based on TNT (trinotrotoluene) having incorporated therein as desensitizer an ozokerite wax.

7 Claims, No Drawings

DESENSITIZED EXPLOSIVE COMPOSITION

RIGHTS OF THE GOVERNMENT

The invention described herein may be manufactured and used by or for the Government of the United States for all governmental purposes without the payment of any royalty.

BACKGROUND OF THE INVENTION

This invention relates to an improved castable high explosive, particularly to a TNT-based explosive.

Explosive compositions based on TNT constitute an important class of military explosives. Examples of such explosive compositions include Composition B (RDX-cyclotrimethylenetrinitramine and TNT-2,4,6-trinitrotoluene), Cyclotols (RDX and TNT in ratios of 75:25 to 60:40), Amatol (ammonium nitrate and TNT), Kalatol (potassium nitrate and TNT), Baratol (barium nitrate and TNT), Pentolite (PETN-pentaerythritol tetranitrate and TNT) and Baronal (barium nitrate, aluminum and TNT). Such compositions are generally prepared by stirring the solid powdered components, which include such materials as RDX, HMX (cyclotetramethylenetetranitramine), PETN, ammonium nitrate, potassium nitrade, barium nitrate, lead nitrate, potassium perchlorate, ammonium perchlorate, aluminum powder, and the like, as well as mixtures thereof, which are essentially insoluble in TNT, with molten TNT until a homogeneous dispersion or slurry is obtained. The molten slurry is loaded into shells or other ordnance items by pouring into the cavity and allowing the melt to cool and solidify. Such slurries, which in concentrated cases are very viscous and difficult to pour, exhibit undesirable segregation and settling of the solids during the period required for cooling and solidification, thereby producing casts of non-uniform composition, which adversely effects the explosive and ballistic characteristics of the item. In the past, small amounts of additives, such as finely divided silica, silicone resins, nitrocellulose and other cellulosic resins, have been added to improve the suspension of the solid components in the TNT slurry.

TNT-based explosive compositions have a tendency to exude low melting impurities such as dinitrotoluene and mononitrotoluene, as well as unsymmetrical isomers of trinitrotoluene. It is known that high molecular weight nitrocellulose has the propensity to accept these low melting impurities of the composition. As a result of substantially high uptake in this regard, relatively small amounts of the nitrocellulose are necessary to prevent exudation of the cast. Thus, the viscosity of the melt is not appreciably altered by the addition of such cellulosic additive and the pourability of the composition is maintained. It has also been found that by such addition of cellulosic material, an explosive cast is obtained having greater mechanical strength and enhanced heat resistance.

In addition to exudation, TNT-based explosive compositions tend to crack upon temperature cycling, decompose autocatalytically upon exposure to fire and explode or detonate when in a bomb or warhead configuration, and further tend to detonate on sudden impact. These drawbacks have been partially corrected in the past by using wax type coatings as desensitizers and process aids. Beeswax was used initially at a level of about 1 wt. percent to desensitize Composition B. Shortages of beeswax led to a search for substitutes which concentrated on paraffin wax, microcrystalline waxes and synthetic waxes. Such wax coatings are deposited irregularly as agglomerates onto the explosive composition. As such, wax coatings tend to separate from the explosive composition surface upon exposure to heat and create potential cook-off conditions.

The waxes employed heretofore are generally not soluble in TNT. In order to form an emulsion of the explosive and wax, emulsifying aids are often added, as for example, lecithin as an emulsifier. Dispersions of 5% or greater of paraffin wax in TNT-based explosives are not truly stable emulsions.

Accordingly, it is an object of the present invention to provide stable TNT/wax emulsions.

Other objects, aspects, and advantages of the invention will be apparent to those skilled in the art.

DESCRIPTION OF THE INVENTION

In accordance with the present invention there is provided an improved explosive composition comprising TNT and an ozokerite wax.

The explosive compositions of the present invention are based upon TNT and, as such, contain about 30 to 99.5 weight percent TNT, and about 0.5 to 25 weight percent of an ozokerite wax, preferably about 4 to 20 weight percent of wax, based upon the total composition weight. These compositions may also contain about 10 to 70 wt. percent of one or more solid, powdered components such as PETN, cyclic nitramines such as HMX and RDX, oxidizers such as ammonium nitrate, potassium nitrate, barium nitrate, lead nitrate, potassium perchlorate and ammonium perchlorate, aluminum powder, and the like. Additionally, these compositions comprise about 0.025 to 0.20 weight percent of an emulsifier, such as lecithin, and about 0.5 to 2.5 weight percent of a stabilizer, such as nitrocellulose or other thermoplastic resin of the cellulosic variety.

Ozokerite is a mineral wax having a specific gravity of about 0.89, which fuses at about 60° to 80° C. and is over 99% soluble in carbon disulfide.

The ozokerite wax, as well as the other components, can be incorporated in the explosive composition in any suitable manner, e.g., by addition to molten TNT directly or by premixing and/or precoating the various components and then mixing these components with the molten TNT.

It is presently preferred to premix the ozokerite wax, emulsifier and cellulosic stabilizer by adding the emulsifier and stabilizer to melted wax, with stirring, to form a homogeneous mixture, cast the mixture into sheets, and then break up the sheet into small chips. Such chips can conveniently be bagged and stored.

The following examples illustrate the invention:

EXAMPLE I

Preparation of wax composition

A wax composition containing 85 wt % ozokerite wax, 14 wt percent Class A nitrocellulose and 1 wt percent dry purified lecithin was prepared as follows:

1. Melt 85 g. of ozokerite 1410 at about 90° C.
2. Add 1 g. dry lecithin to the melted wax.
3. Increase temperature to 110° C.
4. Mix vigorously at 110° C. for 45 minutes.
5. Cool the mixture to 90° C.
6. Slowly add 14 g. (net wt) of alcohol-wet NC to the wax/lecithin mixture.
7. Mix for 20 minutes at 90° C.

8. Increase temperature to 110° C. and mix for 20 minutes.
9. Cast the mixture into sheets and when cooled, break into small chips.

EXAMPLE II

Preparation of Explosive Composition

An explosive composition containing 66 wt % TNT, 16 wt % of the wax composition of Example I and 18 wt % of powdered aluminum was prepared as follows:

1. Melt 66 parts of TNT at about 84° C.
2. Add 16 parts of the wax composition chips of Example I to the melted TNT, with mixing, stirring until an emulsion forms between the TNT and the wax.
3. Slowly add 18 parts of Al powder (preheated to about 80° C.).
4. Thoroughly mix the Al into the TNT/wax mixture, then cast into a suitable mold.

The Theoretical Maximum Density (TMD) of this composition was calculated to be 1.59 g/cc. This explosive composition when cast into an unconfined mold had a density of 1.53 g/cc (96% TMD).

The sensitivity characteristics of the above explosive composition is given along with the characteristics of other compositions in Table I, below.

TABLE I

| Test No. | Formulation (TNT/wax*/Al) | Impact P-50% (cm) 5 Kg wt | Initiation Pressure (Kbar) | Detonation Velocity (Km/sec) | Critical Dia (inch) |
|---|---|---|---|---|---|
| 1 | 100/0/0 | 55 | 14 | 6.9 | 0.6*** |
| 2 | 80/0/20 | 50 | 14 | 6.5 | — |
| 3 | 91/9**/0 | 170 | 25 | 6.6 | <1.0 |
| 4 | 82/18**/0 | >200 | 42 | 6.2 | — |
| 5 | 74/8/18 | >200 | 30 | 6.3 | 0.50 |
| 6 | 70/12/18 | >200 | 42 | 6.1 | 0.67 |
| 7 | 66/16/18 | >200 | 50 | 6.0 | 0.88 |

*85 parts wax, 14 parts NC, 1 part lecithin
**Type 1026 ozokerite wax; all others use Type 1410.
***Literature value Ozokerite wax forms truly stable emulsions with TNT which solidify upon cooling. The viscosity of the emulsions increases with increasing concentrations of wax. The impact sensitivity height of the compositions also increases with increasing concentrations of wax. Below about 16 wt percent wax the emulsion appears to be a wax-in-TNT emulsion; above 16 wt percent wax the emulsion appears to be a TNT-in-wax emulsion.

Various modifications may be made to the present invention without departing from the spirit and scope of the invention.

I claim:

1. A melt-cast, TNT-based explosive composition consisting essentially of about 30 to 99.5 weight percent trinitrotoluene, about 4 to 20 weight percent ozokerite wax, about 0.025 to 0.20 weight percent emulsifier and about 0.5 t0 2.5 weight percent cellulosic material.

2. The composition of claim 1 additionally containing about 10 to 70 weight percent of a powdered component selected from the group consisting of pentaerythritol tetranitrate, cyclic nitramines, oxidizers and aluminum.

3. The composition of claim 2 containing 66 parts trinitrotoluene, 18 parts powdered aluminum and 16 parts of a wax composition containing 85 weight percent ozokerite, 14 weight percent nitrocellulose and 1 weight percent lecithin.

4. The composition of claim 2 containing 70 parts trinitrotoluene, 18 parts powdered aluminum and 12 parts of a wax composition containing 85 weight percent ozokerite wax, 14 weight percent nitrocellulose, and 1 weight percent lecithin.

5. The composition of claim 2 containing 74 parts trinitrotoluene, 18 parts powdered aluminum, and 8 parts of a wax composition containing 85 weight percent ozokerite wax, 14 weight percent nitrocellulose, and 1 weight percent lecithin.

6. The composition of claim 1 containing 82 parts trinitrotoluene and 18 parts of a wax composition containing 85 weight percent ozokerite wax, 14 weight percent nitrocellulose and 1 weight percent lecithin.

7. The composition of claim 1 containing 91 parts trinitrotoluene and 9 parts of a wax composition containing 85 weight percent ozokerite wax, 14 weight percent nitrocellulose and 1 weight percent lecithin.

* * * * *